US010436002B2

(12) United States Patent
Soliman et al.

(10) Patent No.: US 10,436,002 B2
(45) Date of Patent: Oct. 8, 2019

(54) METHOD FOR ENHANCING FRACTURE PROPAGATION IN SUBTERRANEAN FORMATIONS

(71) Applicant: Texas Tech University System, Lubbock, TX (US)

(72) Inventors: Mohamed Soliman, Lubbock, TX (US); Mehdi Rafiee, Lubbock, TX (US); Elias Pirayesh, Lubbock, TX (US)

(73) Assignee: Texas Tech University System, Lubbock, TX (US)

( * ) Notice: Subject to any disclaimer, the term of this patent is extended or adjusted under 35 U.S.C. 154(b) by 467 days.

(21) Appl. No.: 14/433,464

(22) PCT Filed: Sep. 23, 2013

(86) PCT No.: PCT/US2013/061134
§ 371 (c)(1),
(2) Date: Apr. 3, 2015

(87) PCT Pub. No.: WO2014/055273
PCT Pub. Date: Apr. 10, 2014

(65) Prior Publication Data

US 2015/0204175 A1 Jul. 23, 2015

Related U.S. Application Data

(60) Provisional application No. 61/709,792, filed on Oct. 4, 2012.

(51) Int. Cl.
*E21B 43/26* (2006.01)
*E21B 43/30* (2006.01)

(52) U.S. Cl.
CPC ..... *E21B 43/26* (2013.01); *E21B 43/305* (2013.01)

(58) Field of Classification Search
CPC ..... E21B 43/26; E21B 43/114; E21B 43/25; E21B 43/261; E21B 43/267; E21B 43/305
See application file for complete search history.

(56) References Cited

U.S. PATENT DOCUMENTS 8,210,257 B2 7/2012 Dusterhoft et al.
8,439,116 B2 * 5/2013 East, Jr. ..... E21B 43/26 166/250.1

(Continued)

OTHER PUBLICATIONS

"Proper Evaluation of Shale Gas Reservoirs Leads to a More Effective Hydraulic-Fracture Stimulation," SPE123586, 2009 SPE Rocky Mountain Oil & Gas Technology Symposium in Denver, Colo.*

(Continued)

*Primary Examiner* — Daniel P Stephenson
(74) *Attorney, Agent, or Firm* — Edwin S. Flores; Daniel J. Chalker; Chalker Flores, LLP

(57) ABSTRACT

The present invention provides a method of hydraulically fracturing a well penetrating an subterranean formation by optimizing the spacing of fractures along a wellbore to form a complex network of hydraulically connected fractures by identifying a deviated wellbore in a subterranean formation; introducing a series of fractures in the deviated wellbore, wherein the series of fractures comprising at least a first fracture, a second fracture, a third fracture and a fourth fracture each separated by a non-uniformed and an increased spacing distance such that the spacing distance from each adjacent fracture in the series of fractures is at an increased distance; and forming one or more complex fractures extending from the series of fractures to form a complex fracture network.

19 Claims, 12 Drawing Sheets

(56) References Cited

U.S. PATENT DOCUMENTS

| | | | | |
|---|---|---|---|---|
| 2004/0023816 | A1 | 2/2004 | Burts | |
| 2005/0121193 | A1* | 6/2005 | Buchanan | E21B 43/305 166/281 |
| 2005/0211439 | A1 | 9/2005 | Willett et al. | |
| 2006/0070740 | A1 | 4/2006 | Surjaatmadja et al. | |
| 2011/0017458 | A1 | 1/2011 | East, Jr. et al. | |
| 2011/0029868 | A1 | 9/2011 | Dusterhoft et al. | |
| 2011/0284214 | A1 | 11/2011 | Ayoub et al. | |
| 2013/0032350 | A1* | 2/2013 | Potapenko | E21B 43/26 166/308.1 |
| 2015/0075779 | A1* | 3/2015 | Walters | E21B 49/008 166/250.1 |
| 2015/0204175 | A1* | 7/2015 | Soliman | E21B 43/305 166/308.1 |
| 2016/0003017 | A1* | 1/2016 | Keller | E21B 43/162 166/250.1 |
| 2016/0357883 | A1* | 12/2016 | Weng | E21B 43/26 |
| 2017/0145793 | A1* | 5/2017 | Ouenes | E21B 41/0092 |

OTHER PUBLICATIONS

International Search Report PCT/US2013/061134 {KIPO} dated Dec. 23, 2013.

* cited by examiner

METHOD FOR ENHANCING FRACTURE PROPAGATION IN SUBTERRANEAN FORMATIONS

CROSS-REFERENCE TO RELATED APPLICATIONS

This application claims priority to, and is the National Stage of International Application No. PCT/US2013/061134 filed on Sep. 23, 2013 and claims the priority of U.S. Provisional Patent Application Ser. No. 61/709,792, filed on Oct. 4, 2012, the contents of which are incorporated by reference herein in their entirety.

TECHNICAL FIELD OF THE INVENTION

The present invention relates generally to compositions and methods for hydraulic fracturing of an earth formation and in particular, to compositions and methods for hydraulic fracturing by optimizing the placement of fractures along the deviated wellbores to enhance far field complexity and maximizing the stimulated reservoir volume.

BACKGROUND ART

Without limiting the scope of the invention, its background is described in connection with hydraulic fracturing to enhance production of trapped hydrocarbons. Conventional fracture designs focus on the creation of a fracture of desirable length, height and width. It is also desirable to increase fluid efficiency to reduce the amount of fluid to be used and to minimize damage to the proppant pack in the fracture. Such considerations typically lead to a fracture design using a reasonably high pump rate and as low a viscosity of the fracturing fluid as possible given the viscosity requirement for the desired fracture size.

In recent years, new fracturing designs and techniques have been developed to enhance production of trapped hydrocarbons. The new techniques focus on reducing stress contrast during fracture propagation while enhancing far field complexity and maximizing the stimulated reservoir volume.

For example, U.S. Pat. No. 8,210,257, incorporated herein by reference, entitled "Fracturing a stress-altered subterranean formation" discloses a wellbore in a subterranean formation includes a signaling subsystem communicably coupled to injection tools installed in the wellbore. Each injection tool controls a flow of fluid into an interval of the formation based on a state of the injection tool. Stresses in the subterranean formation are altered by creating fractures in the formation. Control signals are sent from the wellbore surface through the signaling subsystem to the injection tools to modify the states of one or more of the injection tools. Fluid is injected into the stress-altered subterranean formation through the injection tools to create a fracture network in the subterranean formation. In some implementations, the state of each injection tool can be selectively and repeatedly manipulated based on signals transmitted from the wellbore surface. In some implementations, stresses are modified and/or the fracture network is created along a substantial portion and/or the entire length of a horizontal wellbore.

Still another example includes U.S. patent application Publication Number US 2011/0017458, incorporated herein by reference, which discloses a method of inducing fracture complexity within a fracturing interval of a subterranean formation comprising characterizing the subterranean formation, defining a stress anisotropy altering dimension, providing a wellbore servicing apparatus configured to alter the stress anisotropy of the fracturing interval of the subterranean formation, altering the stress anisotropy within the fracturing interval, and introducing a fracture in the fracturing interval in which the stress anisotropy has been altered. A method of servicing a subterranean formation comprising the steps of introducing a fracture into a first fracturing interval, and introducing a fracture into a third fracturing interval, wherein the first fracturing interval and the third fracturing interval are substantially adjacent to a second fracturing interval in which the stress anisotropy is to be altered.

Still another example includes U.S. patent application Publication Number US 2004/0023816, incorporated herein by reference, which discloses a hydraulic fracturing treatment to increase productivity of subterranean hydrocarbon bearing formation, a hydraulic fracturing additive including a dry mixture of water soluble crosslinkable polymer, a crosslinking agent, and a filter aid which is preferably diatomaceous earth. The method of forming a hydraulic fracturing fluid includes contacting the additive with water or an aqueous solution, with a method of hydraulically fracturing the formation further including the step of injecting the fluid into the wellbore.

DISCLOSURE OF THE INVENTION

Creation of complex fracture networks away from the wellbore may not be achieved by conventional fracturing techniques. Recently developed techniques are designed to overcome this problem however; those techniques are operationally difficult to perform. This invention discloses a method used to design new fracturing schemes based on mechanical properties of the subterranean formation. The ultimate objective of the disclosed invention is to enhance production from unconventional reservoirs by optimizing the fracture placement in hydraulic fracturing designs.

The role of geomechanics in design and evaluation of hydraulic fracture stimulations in unconventional reservoirs has become more important than ever. Microcosmic mapping provides a good estimation of fracture geometry and stimulated reservoir volume (SRV); however, without geomechanical considerations, the predictions may not be completely accurate. By understanding reservoir rock mechanics and those parameters that have a major impact on the performance of fracture treatments, more reliable decisions in fracturing design and optimization can be made. The present invention provides an analytical method that predicts the changes in stress anisotropy in the neighborhood of the fractures of different designs in an elastic-static medium. Also, the present invention provides a numerical model to investigate the effect of different geomechanical parameters on the geometry of the fractures. Results show that the spacing between fractures has a major impact on the changes in stresses. The effect of well spacing on fracture geometry in modified zipper frac design has been investigated. The present invention provides an optimization of fracture placement in newly developed designs of hydraulic fractures in horizontal wellbores.

The present invention provides a method of hydraulically fracturing a well penetrating an subterranean formation by optimizing the spacing of fractures along a wellbore to form a complex network of hydraulically connected fractures by identifying a deviated wellbore in a subterranean formation; introducing a series of fractures in the deviated wellbore, wherein the series of fractures comprising at least a first fracture, a second fracture, a third fracture and a fourth fracture each separated by a non-uniformed and an increased spacing distance such that the spacing distance from each adjacent fracture in the series of fractures is at an increased distance; and forming one or more complex fractures extending from the series of fractures to form a complex fracture network.

The one or more complex fractures may connect to one or more pre-existing network of natural fractures to form the complex fracture network and the series of as fractures reduces a principal stress, a shear stress or both. The series of as fractures are generated as a function of a fluid flow and a stress interference and a minimum stress exists so that a net pressure can overcome a stress anisotropy to create a longer fracture. The series of as fractures can reduce a stress anisotropy between a first and second horizontal stresses and the series of as fractures changes the magnitude of horizontal stresses. The subterranean formation may be a shale or a tight sand reservoir.

The present invention also provides a method of forming a series of non-uniformly spaced fractures penetrating an subterranean formation to form a complex network of hydraulically connected fractures by identifying a deviated wellbore in a subterranean formation; introducing a series of fractures in the deviated wellbore, wherein the series of fractures comprising at least a first fracture, a second fracture, a third fracture and a fourth fracture each separated by a non-uniformed and an increased spacing distance such that the spacing distance from each adjacent fracture in the series of fractures is at an increased distance; and forming one or more complex fractures extending from the series of fractures to form a complex fracture network.

The present invention provides a method of altering the stress anisotropy in a subterranean formation by hydraulically fracturing in a series of non-uniformly spaced fractures by identifying a deviated wellbore in a subterranean formation; introducing a series of fractures in the deviated wellbore as a function of a fluid flow and a stress interference, wherein the series of fractures comprise at least a first fracture, a second fracture, a third fracture and a fourth fracture each separated by a non-uniformed and increasing spacing distance, wherein the series of fractures are at a greater distance from the previous fracture.

In addition, the present invention also provides a method for enhancing far field complexity in subterranean formations during hydraulic fracturing treatments by means of optimizing the placement of fractures along the deviated wellbores. In this method two or more parallel laterals (deviated wells) may each be hydraulically fractured in a specific sequence forming a series of non-uniformly spaced fractures to alter the stress anisotropy in the formation. Each of the multiple deviated wellbores include a series of non-uniformly spaced fractures penetrating the subterranean formation to form a complex network of hydraulically connected fractures by identifying a deviated wellbore in a subterranean formation; introducing a series of fractures in the deviated wellbore, wherein the series of fractures comprising at least a first fracture, a second fracture, a third fracture and a fourth fracture each separated by a non-uniformed and an increased spacing distance such that the spacing distance from each adjacent fracture in the series of fractures is at an increased distance; and forming one or more complex fractures extending from the series of fractures to form a complex fracture network.

In another embodiment, the two or more parallel laterals (deviated wells) may each be hydraulically fractured in a specific sequence forming a series of non-uniformly spaced fractures to alter the stress anisotropy in the formation. If single cluster stages are to be designed, fractures in a specific sequence forming a series of non-uniformly spaced fractures such that after introducing the first and the second fractures in one of the wells, the third fracture may be created in the other well in a distance between the first two fractures. The third fracture extends to the area between the first two fractures and alters the stress field (changes the magnitude of horizontal stresses) in that region. Each of the multiple deviated wellbores include a series of non-uniformly spaced fractures penetrating the subterranean formation to form a complex network of hydraulically connected fractures by identifying a deviated wellbore in a subterranean formation; introducing a series of fractures in the deviated wellbore, wherein the series of fractures comprising at least a first fracture, a second fracture, a third fracture and a fourth fracture each separated by a non-uniformed and an increased spacing distance such that the spacing distance from each adjacent fracture in the series of fractures is at an increased distance; and forming one or more complex fractures extending from the series of fractures to form a complex fracture network. Since fractures tend to open in a direction perpendicular to the direction of minimum horizontal stress, the change in magnitude of SH minimum is larger than the change in the magnitude of SH maximum. Thus, after introducing the third fracture the different between two principal horizontal stresses (stress anisotropy) approaches zero. When there is no stress anisotropy in the subterranean formation, fractures may open in any direction and connect to the pre-existing network of natural fractures which eventually results in the creation of a complex network of fractures. A complex network of hydraulically connected fractures may improve the production of trapped hydrocarbons in tight subterranean formations such as shale and tight sand reservoirs.

DESCRIPTION OF THE DRAWINGS

For a more complete understanding of the features and advantages of the present invention, reference is now made to the detailed description of the invention along with the accompanying figures and in which.

DESCRIPTION OF THE INVENTION

Figures 1A, 1B, 1C, 1D:
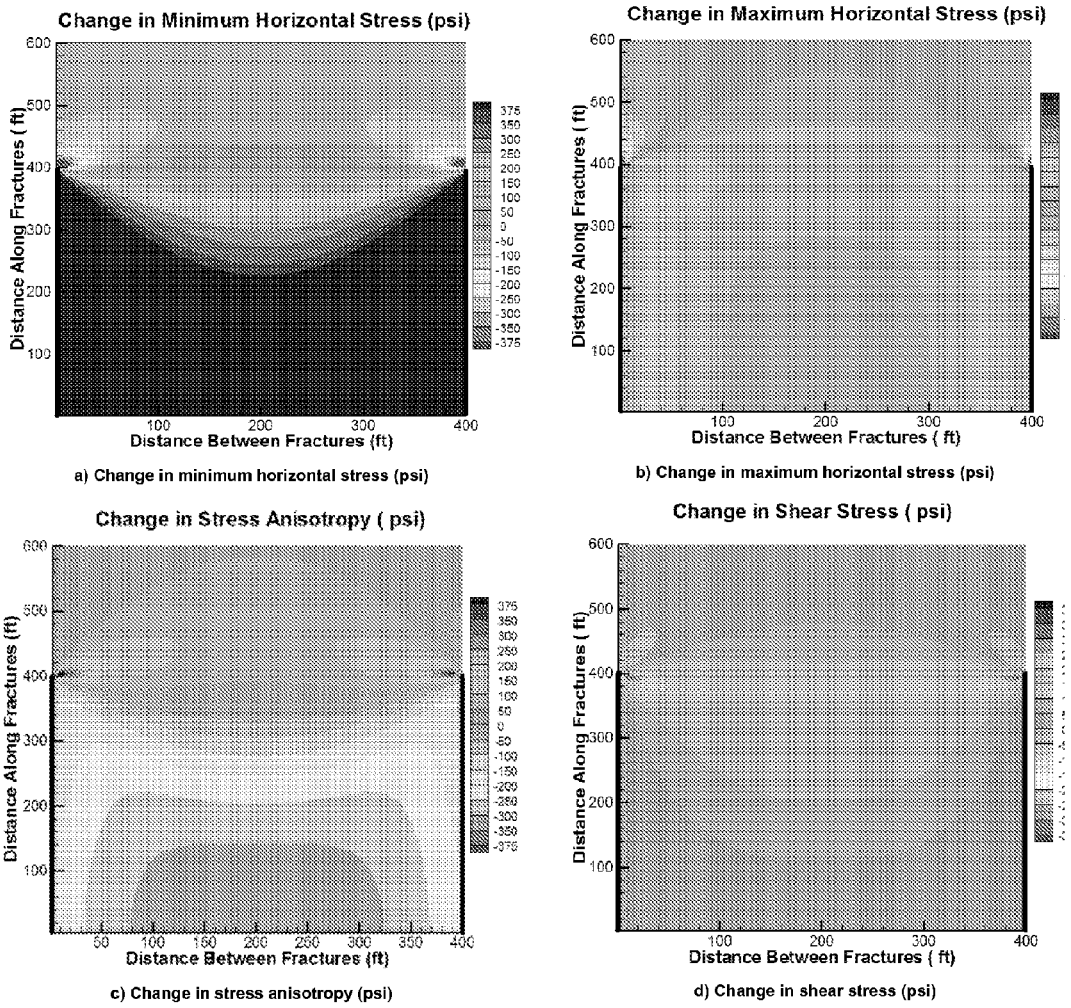
FIGS. 1*a*-1*d* are plots of the change in stresses in the area between two fractures.
Figures 2A, 2B, 2C, 2D:
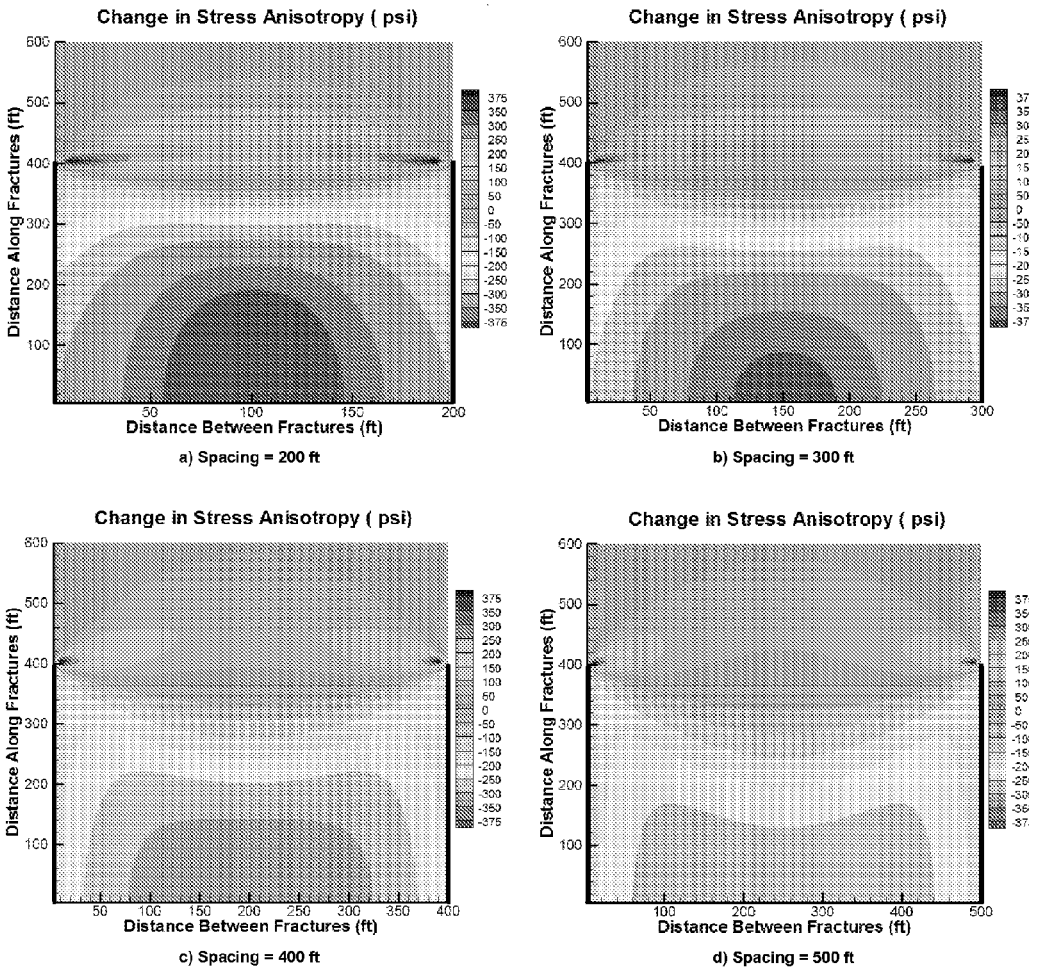
FIGS. 2*a*-2*d* are plots of the change in stress anisotropy in the area between two fractures.
Figures 3A, 3B, 3C, 3D:
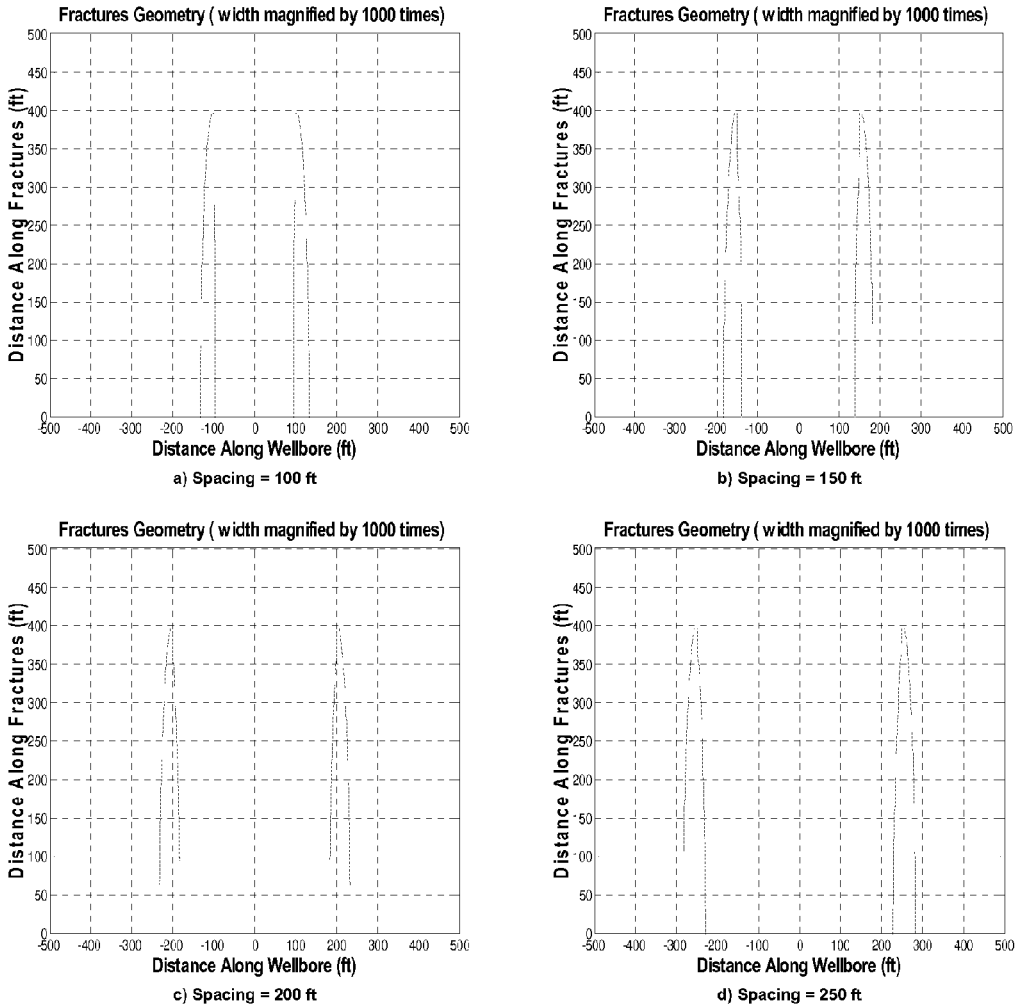
FIGS. 3*a*-3*d* are plots of the variations of fracture width along the fractures in different spacing.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

Unless otherwise specified, use of the term "subterranean formation" shall be construed as encompassing both areas below exposed earth and areas below earth covered by water such as ocean or fresh water.

It has been well established that hydraulic fractures in earth formations emanating from a wellbore will form generally opposed fracture wings which extend along and lie in a plane which is normal to the minimum in situ horizontal stress in the formation zone being fractured. Ideally, the fractures form as somewhat identical opposed "wings" extending from a wellbore which has been perforated in several directions with respect to the wellbore axis. This classic fracture configuration holds generally for formations which have been penetrated by a substantially vertical well and for formations which exhibit a minimum and maximum horizontal stress distribution which intersect at an angle of approximately 90 degree. However, many wells are drilled at an angle to the vertical, either intentionally or as a result of deviation of the drill pipe so that the wellbore does not lie in a plane normal to the minimum horizontal stress. Accordingly, fractures formed at the wellbore have to reorient such that the fracture face is perpendicular to the minimum stress. Still further, some wellbores which are severely deviated from the vertical can generate multiple fractures. The existence of multiple fractures may cause severe fracture width restriction and friction pressure losses as the fracture fluid is attempted to be pumped into the formation to create the desired fracture configuration. To minimize the fracture width reduction caused by multiple fractures it is, of course, necessary to minimize the number of fractures.

The present invention discloses a method for enhancing fracture propagation in subterranean formations during hydraulic fracturing treatments by optimizing the placement of fractures along the deviated wellbores. The fractures can be placed in the same manner as the conventional fracturing but with different spacing along the wellbore. In hydraulic fracturing the optimum spacing is a function of fluid flow and stress interference. The present invention places fractures at different spacing. In conventional hydraulic fracturing, fractures are placed along the wellbore with consistent spacing. The net pressure created as a result of introducing the first fracture will affect the initiation of the second and subsequent fractures.

Therefore, the net pressure required for the creation of each fracture is a function of cumulative stresses induced by all previously created fractures. Hence, fractures near the heel of the deviated section require a large net pressure to open that may exceed the maximum allowable pump pressure. This may result in the creation of short transverse fractures, or in some cases where the stress anisotropy reverses near the wellbore, axial fractures may be formed. Axial fractures and short transverse fractures are not favorable from a production perspective.

The role of geomechanics in design and evaluation of hydraulic fracture stimulations in unconventional reservoirs has become more important than ever. Microcosmic mapping provides a good estimation of fracture geometry and stimulated reservoir volume (SRV);

however, without geomechanical considerations, the predictions may not be completely accurate. By understanding reservoir rock mechanics and those parameters that have a major impact on the performance of fracture treatments, more reliable decisions in fracturing design and optimization can be made. The present invention provides an analytical model that predicts the changes in stress anisotropy in the neighborhood of the fractures of different designs in an elastic-static medium. The present invention also provides a numerical model to investigate the effect of different geomechanical parameters on the geometry of the fractures. Results show that the spacing between fractures has a major impact on the changes in stresses. The effect of well spacing on fracture geometry in modified zipper frac design has been investigated and results in valuable insight into optimization of fracture placement in newly developed designs of hydraulic fractures in horizontal wellbores.

Multistage fracturing of horizontal wells has become widely used to produce hydrocarbon from previously unproductive formations such as shales and tight gas sands. The technology has greatly improved in the past decade to accommodate industry needs in the development of unconventional reservoirs. Records of nearly 50 stages have been reported for open hole completions in Bakken shale (Themig 2010). Although it is critical to place as many fractures as possible to deplete the reservoirs (Soliman, Hunt and Azeri 1999; Ozkan et al. 2009), there is no evidence to confirm that ultimate production increases proportionally with the increase in the number of fractures. Thus, it becomes significantly important to optimize a design in which the necessity of creating each fracture has been assessed based on engineering principals and economic justifications.

There are several important factors in performing a successful hydraulic fracturing treatment; the most important is the fracture spacing (Cheng 2009). An optimized design for fracture placement, along the wellbore, should create large fracture surface area and sufficient fracture width to allow for proppant settling, forming a conductive path from formation to the wellbore. In particular, fracturing horizontal wellbores with multiple transverse fractures creates large surface areas in contact with the reservoir. However, the opening of the fractures is highly dependent on the net pressure and the spacing between fractures. As noted by Soliman et al. (2008), the spacing between fractures is limited by the stress perturbation caused by the opening of propped fractures. Fracturing designs can be optimized if the original stress anisotropy is known and the stress perturbation can be predicted (Soliman et al. 2010). Several authors have investigated stress perturbation around single (Wood and Junki 1970; Warpinski, Wolhart and Wright 2004) and multiple (Cheng 2009; Roussel and Sharma 2011) fractures. However, there is a lack of study on the change of stress anisotropy in different designs of multistage fracturing.

The present invention provides variations in the net pressure and fracture spacing on the change of stress anisotropy and fracture geometry in different patterns and sequences of fracture placement. Changes in stresses are predicted using an analytical model, while fracture openings are investigated using a numerical solution developed based on boundary element method.

The boundary element method (BEM) was used as an effective tool in solving fracture mechanics types of problems. BEM is a numerical computational method of solving linear partial differential equations that have been formulated in boundary integral form (Crouch 1974) and is used in numerous engineering areas. Because of its suitability, a BEM devised to cope with crack-type problems (e.g., the displacement discontinuity method) was chosen for this particular case. The displacement discontinuity method is based on an analytical solution developed for a problem of a constant displacement along a finite line segment in an infinite elastic solid in the x-y plane. This method provides a way for making discrete approximations of displacement discontinuity along a line with unknown displacement discontinuity distribution. Cheng (2009) extensively discussed this method and its application in hydraulic fracturing modeling.

As the fracture propagates in the formation, it alters the stress field in the surrounding area. The change in stress highly depends on the mechanical properties of the rock, the geometry of the fracture, and the pressure inside the fracture (Warpinski et al. 2004). Green and Sneddon (1950) developed an analytical solution to calculate the change in stress in the neighborhood of an elliptical crack. The solution has been discussed in length in previous works (Warpinski et al. 2004; Soliman et al. 2010; Rafiee et al. 2012). In the case of multiple fractures, the principal of superposition can be used to calculate the stresses in the area between fractures. This calculation is important when plains of weaknesses or natural fractures exist in the formation. Change in the magnitude of stress anisotropy, if designed properly, may create secondary fractures that connect the main hydraulic fracture with stress-relief fractures. As a result, a network of connected fractures will be created, which enhances the stimulated reservoir volume (SRV). In the following sections, we first show the calculation for the magnitude of change in principal stresses as a result of creating two fractures. Next, we calculate and analyze the effect of different parameters, such as net pressure and fracture spacing, on the stress anisotropy between two fractures. Also, the effects of these parameters on the geometry of fractures are presented in this paper.

FIGS. 1*a*-1*d* are plots of the change in stresses in the area between two fractures.

Fractures in FIG. 1, and in all other figures with similar format presented herein are placed in a direction normal to the plane of the figure with a wellbore passing through the center of the fractures. The contours in the figures are leveled to the value of original stress anisotropy in the formation. The negative and positive signs on the contour bar indicate a decrease and an increase in stress anisotropy respectively. FIG. 1*a* and FIG. 1*b* illustrate the change in the state of stress in the area between two fractures. As shown, the change in minimum horizontal stress is much higher than the change in maximum horizontal stress. This change, known as change in stress anisotropy, reaches a maximum value in the middle of the distance between the two fractures is shown in FIG. 1*c*. As the tip of the fracture advances, the significant change of shear stress near the tip emits shear waves that can be captured by the microseismic receivers, providing a good estimation of fracture geometry. The change of shear stress is shown in FIG. 1*d*.

FIGS. 2*a*-2*d* are plots of the change in stress anisotropy in the area between two fractures. Two transverse fractures are placed in various distances to illustrate the effect of spacing between fractures on the change in stress anisotropy. As shown in FIGS. 2*a*-2*d*, the change reduces to a maximum level (−375 psi) and passes the original anisotropy in the middle of the distance between the two fractures. Considering the original stress anisotropy of 375 psi, the region inside the contour of −375 psi experiences stress anisotropy reversal, meaning that if a fracture is initiated in that region, it will propagate longitudinally until it approaches the side fractures, at which point it returns to the normal direction. The concept of creating a third fracture in between the two fractures is known as alternating fracturing (Soliman et al. 2010) and is designed to enhance far field complexity in horizontal wellbores. In the following sections, we compare the effectiveness of this technique with the newly developed modified zipper frac (MZF) design.

FIGS. 3*a*-3*d* are plots of the variations of fracture width along the fractures in different spacing. The displacement of surfaces of pressurized fractures was modeled using the BEM described earlier in this paper. The change in fracture width along the fracture half-length is shown in FIGS. 3*a*-3*d*. Fractures are asymmetric at close distances and become symmetric (elliptic) as spacing increases. The study of variations in fracture width is of high interest in fracturing design because it assures efficient proppant transport deep into the fracture and avoids premature screen out (Economides and Martin 2007).

Figures 4A, 4B, 4C, 4D:
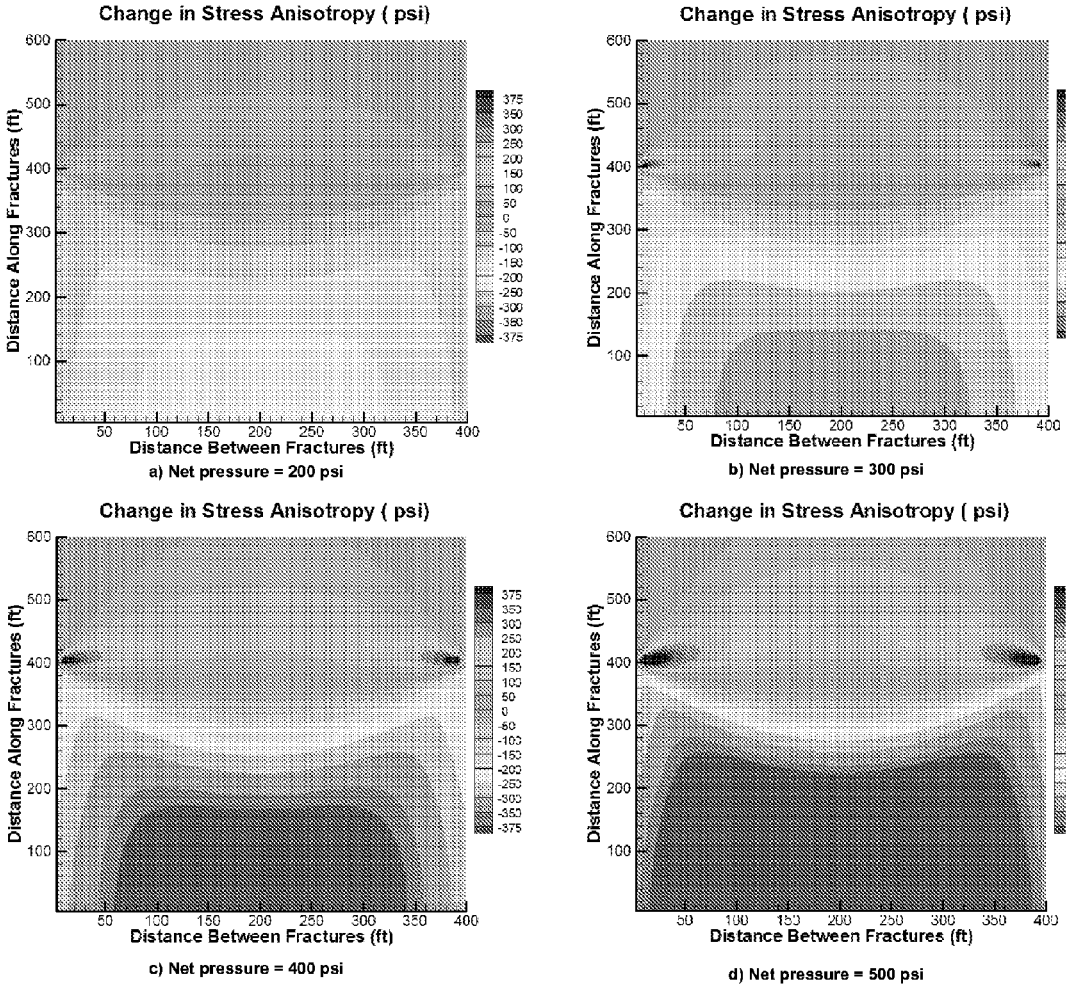
FIGS. 4*a*-4*d* are plots of the change in stress anisotropy in the area between two fractures as a function of change in net pressure.

FIGS. 4*a*-4*d* are plots of the change in stress anisotropy in the area between two fractures as a function of change in net pressure. For a basic case where two fractures are created and spaced 400 ft apart, the effect of net extension pressure on change in stress anisotropy was calculated. FIGS. 4*a*-4*d* show a proportional relationship between the increase in net pressure and the increase in change of stress anisotropy. In alternating fracturing design for this specific example, the optimum net pressure among the four cases shown in FIGS. 4*a*-4*d* are approximately 300 psi to avoid the creation of longitudinal fractures (FIGS. 4*c* and 4*d*) and at the same time to ensure the creation of desired fracture complexity. FIG. 4*a* presents higher stress contrast, which is not in favor of creating complexity.

Figures 5A, 5B:
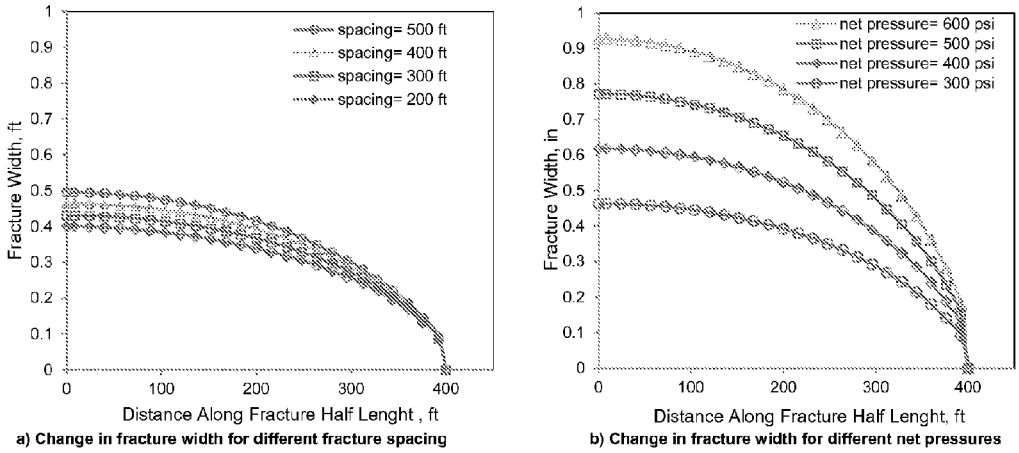
FIGS. 5*a*-5*b* are graphs of the variations of fracture width along the fracture half-length for a single fracture in two transverse fracture patterns.
Figures 6A, 6B, 6C, 6D:
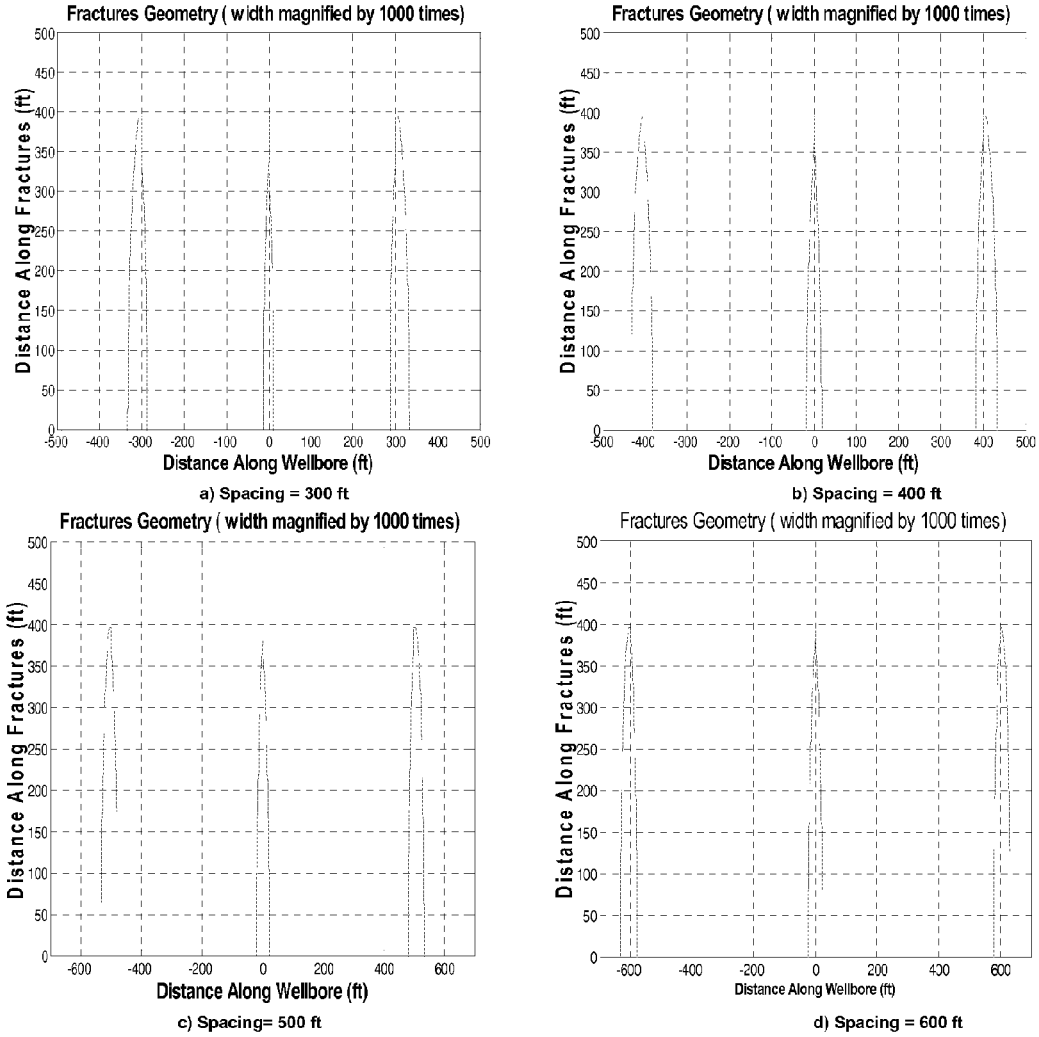
FIGS. 6*a*-6*d* are graphs of the variations of fracture width along the fracture half-length in alternating fracturing design.

FIGS. 5*a*-5*b* are graphs of the variations of fracture width along the fracture half-length for a single fracture in two transverse fracture patterns. The variations of width of fracture along the fracture half-length for the two different cases discussed above are shown in FIGS. 5*a*-5*b*. It is apparent that the width of fracture decreases as the spacing between the two fractures decreases. As mentioned above, the aim in alternating fracturing design is to activate the stress-relief fractures in the area between the two previously created fractures. In this design, the first interval is stimulated at the toe of the horizontal wellbore. Then, moving toward the heel at an optimized spacing, a second interval is stimulated to create a degree of interference between the two fractures. The third fracture is initiated at a distance between the two fractures to alter the plains of weaknesses and create secondary fractures that connect the main hydraulic fractures with pre-existing natural fractures. The completion hardware required to perform alternating fracturing is discussed by East et al. (2011). The technique is not operationally simple to practice; however, it offers a great degree of complexity required to create a connected network of fractures. The middle fracture in alternating fracturing experiences a large amount of stresses induced by the open propped side fractures and may not propagate as long as other fractures.

FIGS. 6*a*-6*d* are graphs of the variations of fracture width along the fracture half-length in alternating fracturing design. The opening of the middle fracture and edge fractures along the half-length with various distances are shown in FIG. 6*a* through 6*d*. This spacing can be optimized to achieve the required width, length, and number of fractures along the horizontal wellbore. The narrower fracture width dictates the use of a lower proppant concentration and size. Typically, small mesh size such as 40/70 or 30/50 is used for the largest part of the job and 20/40 is usually used as a tail-in. The general tendency is to use 20/40 in the oil productive shales such as in the Eagle Ford formation. Smaller mesh size is usually used in gas shales such as in the Barnett, Marcellus, and Woodford shale. In the middle fractures the tendency is to use 100 mesh proppant. In field operations the tendency is to see more sand being pumped and not ceramic or resin coated. The proppant concentration pumped will depend on the type of treatment; whether it is slick water or hybrid frac.

Figure 7:
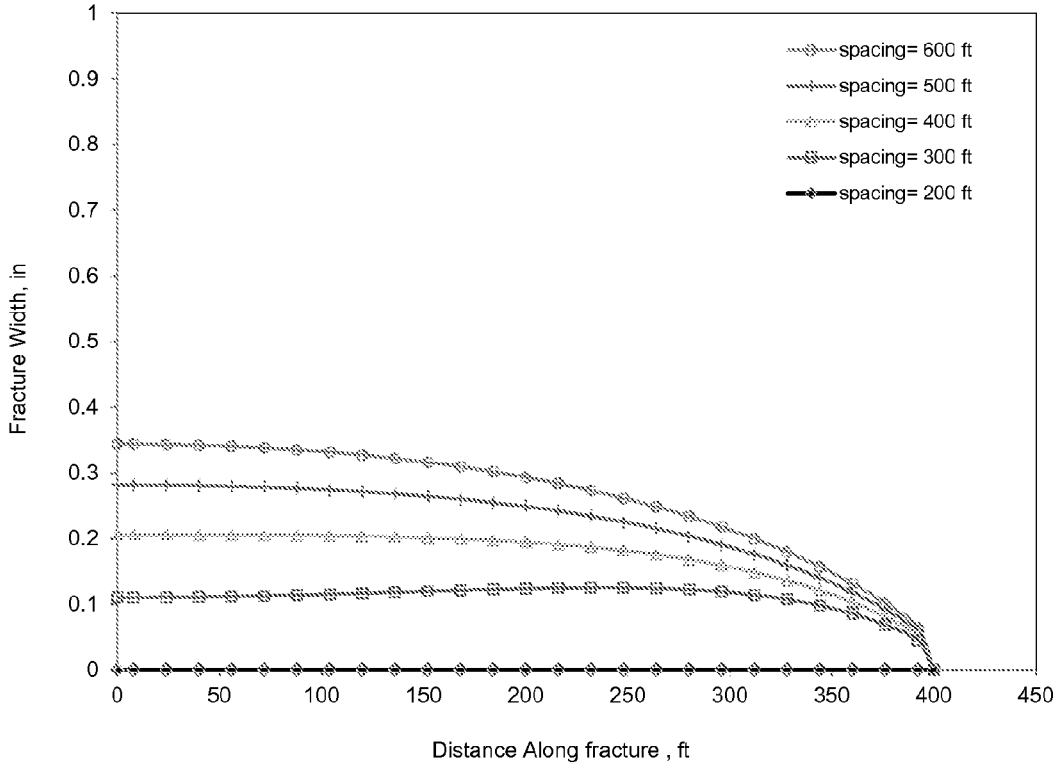
FIG. 7 is a graph of the variations of fracture width along the fracture half-length in alternating fracturing design.

FIG. 7 is a graph of the variations of fracture width along the fracture half-length in alternating fracturing design. The change in the middle fracture opening as a function of change in spacing is illustrated in FIG. 7. The middle fracture presents no conductivity for the case of 200 ft spacing (half of the fracture height). As the spacing increases, the fracture width increases. At the distance equal to 600 ft, the fracture opening is almost triple than the case with 300 ft spacing. However, if fractures are spaced too far apart, the total available number of fractures will be reduced, resulting in less surface area in contact with the reservoir. For optimization purposes, the number of fractures and the geometry of each open propped fracture should be taken into account at the same time. The optimization of completion should include the geomechanics aspects discussed in this paper, coupled with the fluid flow and eventually with the economics evaluation of the project.

Figures 8A, 8B, 8C, 8D:
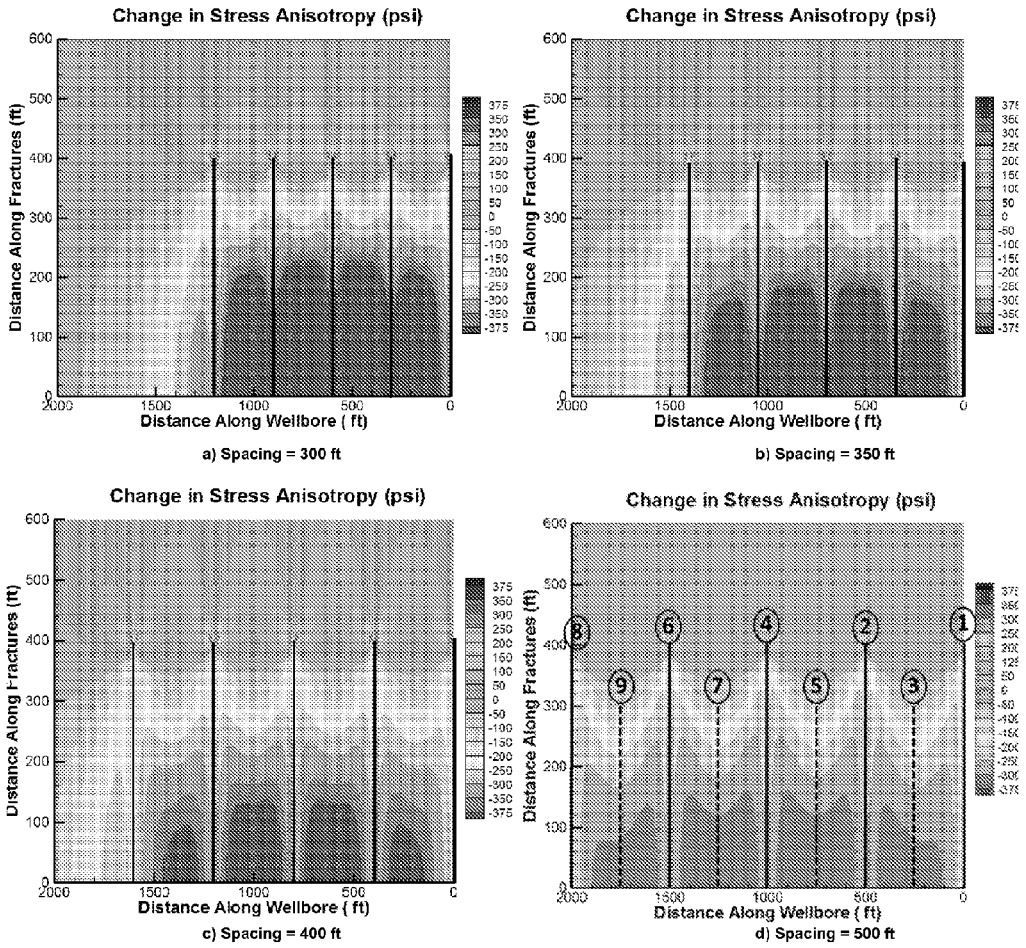
FIGS. 8*a*-8*d* are graphs of the variations of fracture width along the fracture half-length in alternating fracturing design.

FIGS. 8*a*-8*d* are graphs of the variations of fracture width along the fracture half-length in alternating fracturing design. Depending on the quality of the reservoir rock and the existence of natural fractures, one can optimize a proper design to create large surface area in contact with the reservoir by stimulating more open fractures along the horizontal section. If the number of fractures is known in advance, the approach shown in FIGS. 8*a*-8*d* can be implemented to design the placement of fractures with proper geomechanical consideration. In this approach, fractures initially will be placed as close as half of the fracture height, and stress anisotropy will be calculated. Then, considering the actual stress contrast (in this case, 375 psi), one can increase the spacing between fractures until the region of stress anisotropy reversal disappears (FIG. 8*d*). The distance between fractures is now optimized for creating the middle fractures. Although after stimulating the first middle fracture the magnitude of stress changes in the region nearby the second middle fracture, this approach still gives at least a minimum distance required for implementing the alternating technique. As mentioned before, the execution of alternating fracturing requires special downhole tools and is not simple to practice.

Figures 9A, 9B, 9C, 9D:
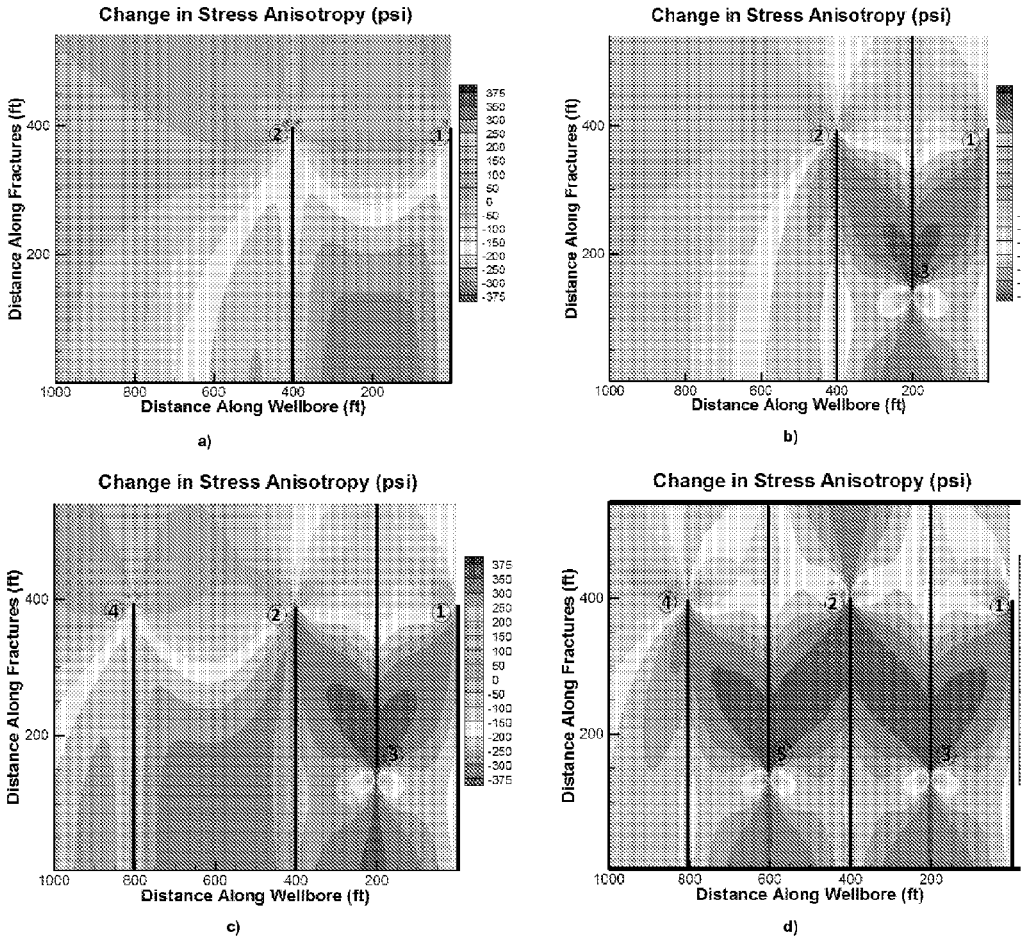
FIGS. 9*a*-9*d* are graphs of the variations of fracture width along the fracture half-length in MZF design.

FIGS. 9*a*-9*d* are graphs of the variations of fracture width along the fracture half-length in MZF design. An alternative approach shown in FIGS. 9*a*-9*d* can be used for designing the placement of fractures in two parallel horizontal wellbores. This technique is a modification to the so-called zipper frac technique and aims to enhance far field complexity in natural fracture reservoirs without the risk of creating longitudinal fractures along the wellbore (Rafiee et al. 2012). In this design, fractures are placed in a staggered pattern to take advantage of the presence of a middle fracture for each two consecutive fractures. The third fracture derives from a second wellbore and propagates to the area in between the two previously stimulated fractures (FIG. 9*b*). This sequence will be repeated along the wellbore until reaching the heel. As a consequence of stress perturbation due to the opening of the side fractures, the geometry of the middle fracture is limited to some extent in the area between two wellbores. Thus, an optimum well spacing should be designed to reach the maximum possible propagation of the middle fractures while ensuring that the desired width is achieved. This technique is not limited to two laterals only but also can be applied in the formations where two or more wells are designed to drain the reservoir. For this specific example, the optimum distance between the first two consecutive fractures was calculated according to the change in stress anisotropy (e.g., FIGS. 2*c*, 4*b*, and 9*a*). The middle fracture, initiated from the other wellbore, changes the stress anisotropy in the neighborhood of the three fractures (FIG. 9*b*). This change will not reverse the anisotropy at the locations of the fourth fracture and even the fifth fracture that is to be initiated from the same wellbore. A close comparison of FIGS. 9*c* and 9*d* shows the effect of induced stresses as a result of creating five fractures. The area between the five fractures is exposed to a large amount of change in stress; however, the area beyond this region (beyond Fracture 4) has not seen significant change in stress. This implies that the center fracture geometries will be different than those of the edge fractures. The results of displacement discontinuity modeling confirm this conclusion.

Figure 10:
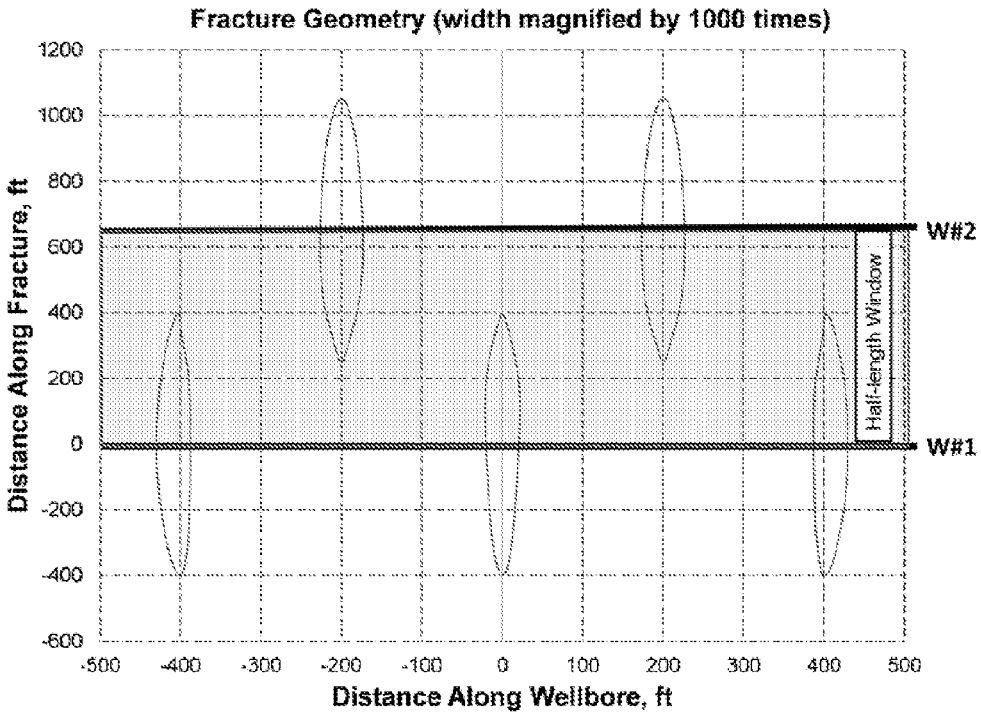
FIG. 10 is a plot of the Fracture Geometry in MZF design (well spacing=650 ft).
Figure 11:
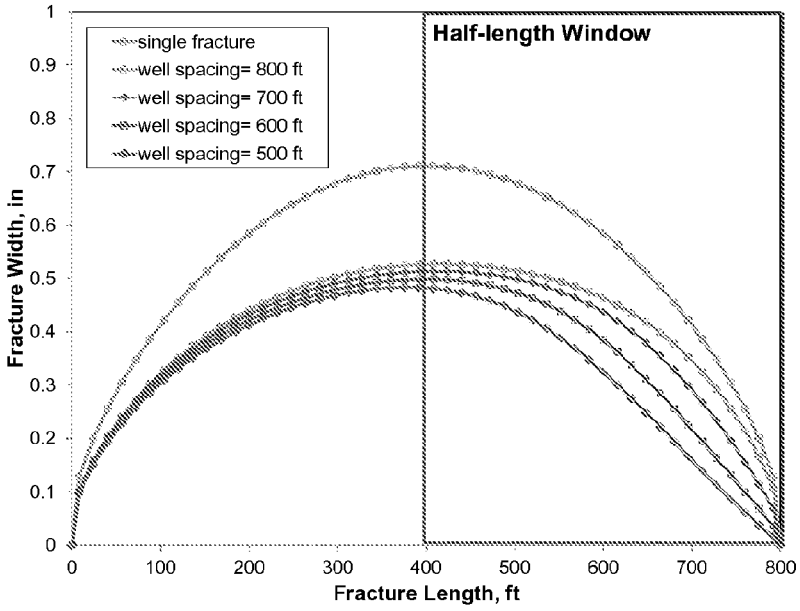
FIG. 11 is a graph of the well spacing on center fracture width in MZF design.

FIG. 10 is a plot of the Fracture Geometry in MZF design (well spacing=650 ft). The effect of fracture interaction is shown in FIG. 10, where all of the fractures are asymmetric along the wellbore. However, unlike the edge fractures, the center fractures are symmetric along the line passing through the tips. The significant stress interference in the half-length window (area between two wells) activates the plains of weaknesses and creates a complex network of fractures in the reservoir. The spacing between wellbores is highly important to achieve this complexity. FIG. 11 is a graph of the well spacing on center fracture width in MZF design. FIG. 11 indicates the change in fracture geometry as a result of the change in well spacing. The spacing between fractures has to be designed to make sure that the middle frac is open. Such consideration will be significantly easier to achieve in MZF than in Alternating fractures. As shown in FIG. 11, decreasing the spacing between two laterals results in a reduction in the width of the center fractures. The fracture widths reduced from 0.52 in. to 0.48 in., when the spacing reduced from 800 ft to 500 ft. In other words, when Fracture 3 propagates longer in the area between Fracture 1 and 2 (e.g., for 300 ft), the width reduces for about only 0.04 in. This example indicates MZF design can be utilized to create complexity with no major reduction in fracture opening.

Figure 12:
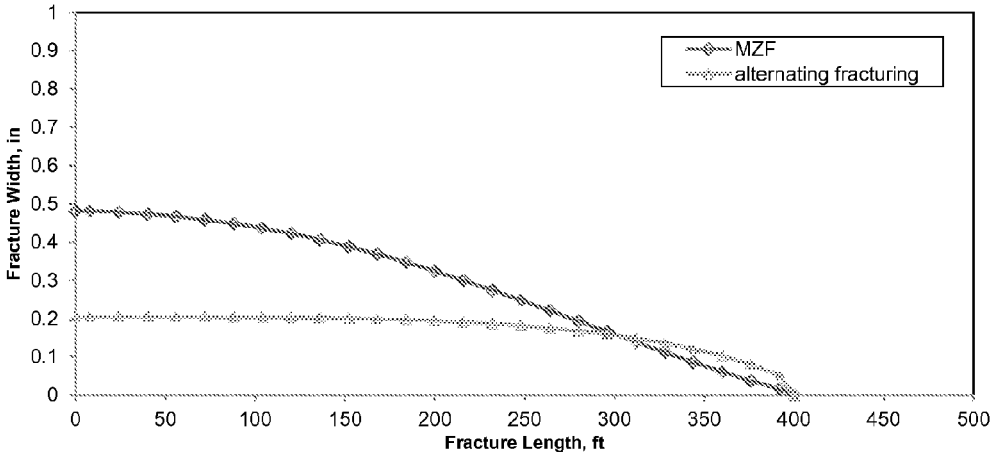
FIG. 12 is a graph of the comparison of geometry of center fracture spaced at 400 ft.

The presented results provide an insight into fracture placement designs based on the geomechanical properties of the reservoir and fracture mechanics. Although these results were obtained for a specific situation, the concepts developed in this study could be utilized for any other case. However, the simplifications made in this study give an approximation to the real problem. Stress anisotropy calculations provide an advantageous method to optimize the distance between fractures in multistage fracturing. The stress reversal regions identified by this method prevent operators from erroneous designs of fracture placement along the wellbore. It is unlikely that fractures placed at distances less than half of the fracture height will propagate equally and provide efficient conductivity. In fact, results of this study show that at a distance equal to half of the fracture height, the conductivity of the center fractures becomes zero; at a distance larger than fracture height, the width at the center of the fracture becomes open up to 0.11 in at the distance equal to the third quarter of fracture height. This could justify reports of production log data that suggest less than 50% of the perforation clusters from a single well contribute to production (Miller et al. 2011). The need for alternating designs arises when numerical models suggest a spare system of effective fractures contribute to production (Mayerhofer et al. 2008; Agarwal et al. 2012). The two designs for fracture placement discussed in this paper can provide the desired complexity and surface area that the current industry method (five to six perforated clusters per 250 ft intervals) aims to attain while ensuring that a sufficient conductivity can be achieved after the treatment. The results show that both alternating and MZF methods can effectively stimulate a large area of the reservoir; however, the fractures created in an MZF design show more conductivity than alternating fracturing. FIG. 12 is a graph of the comparison of geometry of center fracture spaced at 400 ft. These results are based on the assumption of a linearly elastic reservoir with homogenous and isotropic properties. Aforementioned assumptions give approximation to the real problems in the geomechanics context.

The change in stress anisotropy as a result of creating two open propped fractures reaches a maximum value at the middle of the distance between the two fractures. In other words, the stress contrast is minimal at this point. This change increases proportionally with the increase in net extension pressure and decreases as the distance between fractures increases.

Stress reversal occurs if the change in stress anisotropy exceeds the original value. Any fracture initiated in the stress reversal region will propagate along the axis of a wellbore, and a longitudinal fracture will be created. The stress reversal region can be bypassed by increasing the distance between fractures. In this case, an optimum distance can be designed to initiate the third fracture in the middle and repeat this sequence until reaching the heel. Fracture geometry becomes asymmetric after introducing the second fracture. The width of the fracture in this geometry increases with an increase in net pressure and decreases with a decrease in spacing between fractures. In alternating fracturing design, it is unlikely that center fractures spaced less than half of the height of the fractures provide sufficient conductivity.

The spacing between two laterals can be optimized to create fractures that provide sufficient conductivity while reducing the half-length window to create complexity. The results show that the fractures created in MZF design provide more conductivity than those created in alternating fracturing.

Figure 13:
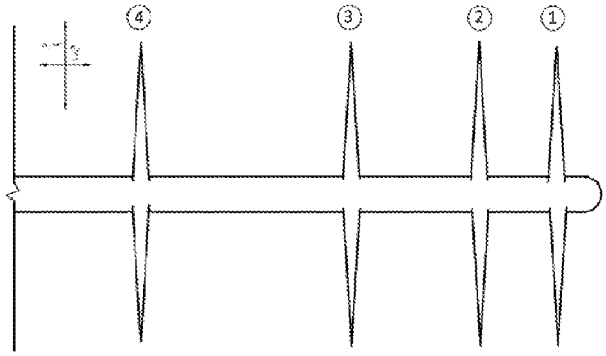
FIG. 13 is an image of the fracture placement and spacing.
Figure 14A:
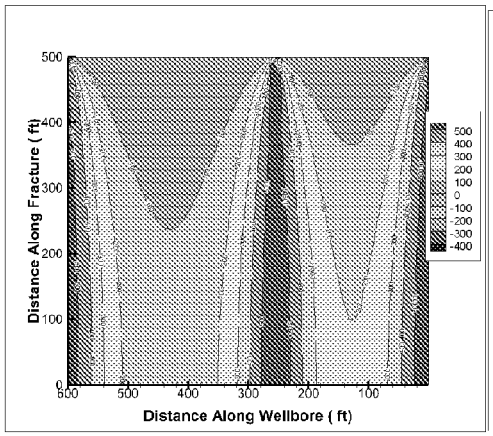
FIGS. 14A-14B are images of the mechanical properties of the subterranean formations.
Figure 14B:
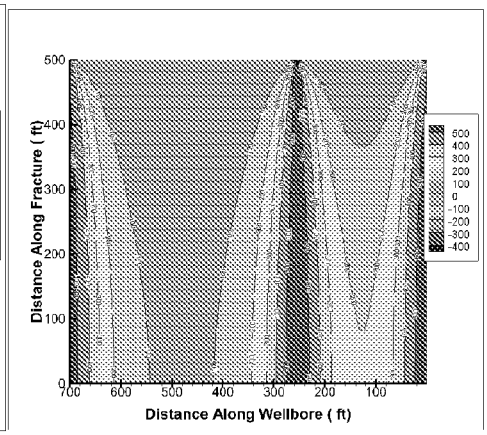

The present invention discloses a method to introduce a fracture at a greater distance from the previous fracture where minimum (optimum) stress exists so that the net pressure can overcome the stress anisotropy, thereby creating a long fracture. FIG. 13 is an image of the fracture placement. Moving from the toe to the heel of the deviated wellbore, greater spacing is required as the new fractures are introduced into the formation as seen in FIG. 13. FIGS. 14A-14B are images of the mechanical properties of the subterranean formations. The spacing design is based on the mechanical properties of the subterranean formations. The ultimate objective of the disclosed invention is to enhance production from unconventional reservoirs by optimizing the fracture placement in hydraulic fracturing designs. Invention can be immediately applied in current hydraulic fracture designs to create longer fractures in subterranean formations. The longer fractures enhance the productivity of the hydraulically fractured well.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A method of hydraulically fracturing a well penetrating a subterranean formation by optimizing the spacing of fractures along two or more wellbores to form a complex network of hydraulically connected fractures comprising the steps of:

identifying two or more deviated wellbores in a subterranean formation;

introducing a series of fractures in the two or more deviated wellbores, wherein the series of fractures comprising at least a first fracture, a second fracture, a third fracture and a fourth fracture each separated by a non-uniformed and an increased spacing distance such that the spacing distance from each adjacent fracture in the series of fractures is at an increased distance; and forming one or more complex fractures extending from the series of fractures to form a complex fracture network, wherein all of the fractures are asymmetric along the wellbore.

2. The method of claim 1, wherein the one or more complex fractures connects to one or more pre-existing network of natural fractures to form the complex fracture network.

3. The method of claim 1, wherein a minimum stress exists so that a net pressure can overcome a stress anisotropy to create a longer fracture.

4. The method of claim 1, wherein the series of as fractures are generated as a function of a fluid flow and a stress interference.

5. The method of claim 1, wherein the series of fractures reduces a principal stress, a shear stress or both.

6. The method of claim 1, wherein the series of fractures reduce a stress anisotropy between a first and second horizontal stresses.

7. The method of claim 1, wherein the series of fractures changes the magnitude of horizontal stresses.

8. The method of claim 1, wherein the subterranean formation comprises a shale or a tight sand reservoir.

9. A method of forming a series of non-uniformly spaced fractures penetrating a subterranean formation to form a complex network of hydraulically connected fractures comprising the steps of:

identifying two or more deviated wellbores in a subterranean formation;

introducing a series of fractures in the two or more deviated wellbores, wherein the series of fractures comprising at least a first fracture, a second fracture, a third fracture and a fourth fracture each separated by a non-uniformed and an increased spacing distance such that the spacing distance from each adjacent fracture in the series of fractures is at an increased distance; and forming one or more complex fractures extending from the series of fractures from each of the two or more wellbores to form a complex fracture network, wherein all of the fractures are asymmetric along the wellbore.

10. The method of claim 9, wherein the one or more complex fractures connects to one or more pre-existing network of natural fractures to form the complex fracture network.

11. The method of claim 9, wherein a minimum stress exists so that a net pressure can overcome a stress anisotropy to create a longer fracture.

12. The method of claim 9, wherein the series of as fractures are generated as a function of a fluid flow and a stress interference.

13. The method of claim 9, wherein the series of fractures reduces a principal stress, a shear stress or both.

14. The method of claim 9, wherein the series of fractures reduce a stress anisotropy between a first and second horizontal stresses.

15. The method of claim 9, wherein the series of fractures changes the magnitude of horizontal stresses.

16. The method of claim 9, wherein the subterranean formation comprises a shale or a tight sand reservoir.

17. A method of altering the stress anisotropy in a subterranean formation by hydraulically fracturing in a series of non-uniformly spaced fractures comprising the steps of:

identifying two or more deviated wellbore in a subterranean formation;

introducing a series of fractures in the two or more adjacent deviated wellbores as a function of a fluid flow and a stress interference, wherein the series of fractures comprise at least a first fracture, a second fracture, a third fracture and a fourth fracture each separated by a non-uniformed and increasing spacing distance, wherein the series of fractures are at a greater distance from the previous fracture wherein all of the fractures are asymmetric along the wellbore; and pumping a quantity of liquid into the two or more deviated wellbores to form the fractures.

18. The method of claim 17, wherein the one or more complex fractures connects to one or more pre-existing network of natural fractures to form the complex fracture network.

19. The method of claim 17, wherein the subterranean formation comprises a shale or a tight sand reservoir.

* * * * *